US006830322B2

(12) United States Patent
Shihoh et al.

(10) Patent No.: US 6,830,322 B2
(45) Date of Patent: Dec. 14, 2004

(54) LIQUID EJECTION APPARATUS

(75) Inventors: Makoto Shihoh, Kanagawa (JP); Osamu Kanome, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/081,206

(22) Filed: Feb. 25, 2002

(65) Prior Publication Data

US 2002/0122084 A1 Sep. 5, 2002

(30) Foreign Application Priority Data

Feb. 27, 2001 (JP) ..... 2001-051396

(51) Int. Cl.[7] ..... B41J 2/175
(52) U.S. Cl. ..... 347/86; 347/85
(58) Field of Search ..... 347/7, 84, 85, 347/86, 87

(56) References Cited

U.S. PATENT DOCUMENTS 4,604,633 A * 8/1986 Kimura et al. ..... 347/7
5,592,200 A * 1/1997 Kaneko ..... 347/30
6,012,795 A * 1/2000 Saito et al. ..... 347/7
6,059,405 A * 5/2000 Mochizuki et al. ..... 347/92

FOREIGN PATENT DOCUMENTS

JP 59-192573 A * 10/1984 ..... B41J/3/04
JP 60-090767 * 5/1985 ..... B41J/3/04
JP 403007350 A * 1/1991 ..... 347/7

* cited by examiner

*Primary Examiner*—Anh T. N. Vo
(74) *Attorney, Agent, or Firm*—Fitzpatrick, Cella, Harper & Scinto

(57) ABSTRACT

A liquid ejection apparatus comprises a liquid bag for containing liquid to be supplied to a liquid ejection head and is adapted to generate negative pressure in the liquid ejection head by a water head difference between the liquid ejection head and the liquid bag. The liquid bag is arranged so that, of two sides of the liquid bag having the largest areas, the side facing in a direction opposite to the direction of gravity is rigidly held at least partly and the other side is freely movable. The liquid bag is provided with a means for detecting an amount of liquid remaining in the liquid bag by reference to a position of the side facing in the direction of gravity, and the detecting means is adapted to move according to the amount of liquid contained in the liquid bag.

2 Claims, 5 Drawing Sheets

LIQUID EJECTION APPARATUS

BACKGROUND OF THE INVENTION

1. Field of the Invention

This invention relates to a liquid ejection apparatus and, more particularly, it relates to a liquid ejection apparatus of the type adapted to generate negative pressure in the liquid ejection head by means of the water head difference between the liquid ejection head and the liquid bag containing liquid to be supplied to the liquid ejection head.

2. Related Background Art

Liquid ejection apparatuses (ink-jet printers) are designed to record images on a recording medium by ejecting liquid such as ink from a liquid ejection means (liquid ejection head) onto the recording medium. Such apparatuses provide a number of advantages including that the liquid ejection means can be easily down-sized, that the apparatus can record high definition images on plain paper without any particular treatment at low running cost, that they are of the no-impact type and hence emit little noise, and that they can record color images by using inks of different colors without difficulty.

The liquid ejection means (liquid ejection head) of the liquid ejection apparatus of the above-identified type is designed to eject liquid from a liquid ejection port by utilizing film boiling that is produced in the liquid such as ink by means of thermal energy generated by an electrothermal transducer or a heat-emitting element. The liquid ejection means (liquid ejection head) of the type that is adapted to eject liquid by utilizing thermal energy as described above can be manufactured by forming its components including the electrothermal transducer, the electrodes, the walls of the liquid flow path and the ceiling plate on a substrate, utilizing a semiconductor manufacturing process that typically involves techniques such as etching, evaporation and sputtering. The manufacturing process makes it possible to densely arrange liquid flow paths and liquid ejection ports without difficulty in order to provide a down-sized liquid ejection means. It is also possible to produce an oblong and/or flat (two-dimensional) liquid ejection means (liquid ejection head) by exploiting the advantages of IC technologies and micro-processing technologies. Then, a liquid ejection apparatus can be equipped with a plurality of liquid ejection means that are mounted densely in the liquid ejection apparatus.

FIG. 6 of the accompanying drawings schematically illustrates a known liquid ejection apparatus of the type under consideration. Referring to FIG. 6, a plurality of (four in FIG. 6) liquid ejection heads (liquid ejection means) 201 are mounted on a carriage 210. The liquid ejection heads 201 are provided respectively with electrothermal transducers (not shown) for generating thermal energy, liquid flow paths through which liquid is supplied, and liquid ejection ports (not shown), and are adapted to eject liquid through the liquid ejection ports, utilizing the pressure change generated by growth and contraction of bubbles due to film boiling of liquid produced by the thermal energy that is generated by the electrothermal transducers. The carriage 210 is reciprocatingly guided by a guide shaft 211 and a guide plate 212. It is driven to reciprocate by a carriage motor 213 by way of a timing belt mechanism 214. An image (including characters and/or signs) is recorded on a recording medium 215, which may typically be a sheet of recording paper, by driving the liquid ejection heads 201 according to recording information applied to them in synchronism with the reciprocating movement of the carriage 210.

As a recording session is completed for a single line, the recording medium 215 is moved forward by a distance corresponding to the line by feed rollers (not shown) and delivery rollers 216. Then, the next recording session starts for the next line, moving the carriage 210 relative to the recording medium 215 that is now lying still. In this way, the image recording operation proceeds until all of the intended image is recorded on the recording medium 215, alternately repeating the intermittent forward movement of the recording medium and the recording session. In FIG. 6, reference symbol 202 denotes cartridges communicating with the respective liquid ejection heads 201 by way of tubes 203 and operating as supply source of liquid such as ink for the liquid ejection heads 201. The cartridges are removably fitted to the main body of the liquid ejection apparatus. In FIG. 6, reference symbol 217 denotes spurs that cooperate with the delivery rollers 216 to forwardly move the recording medium 215.

Liquid ejection recovery system 220 is provided at a position located within the limits of movement of the liquid ejection heads 201 but outside the recording area of the heads, in order to avoid defective liquid ejection (including non-ejection) and maintain the normal function of liquid ejection of the liquid ejection heads 201. The liquid ejection recovery system 220 comprises caps 221 for hermetically sealing (capping) the corresponding liquid ejection ports of the liquid ejection heads 201 and a suction pump (not shown in FIG. 6), which is connected to the inside of the caps 221. The suction pump is driven to operate while the liquid ejection heads 201 are capped so as to apply negative pressure to the liquid ejection ports and draw out of the ejection ports foreign objects, such as thickened liquid, air bubbles and dust, with liquid. The foreign objects that are thus drawn out are then driven out through tubes 222.

As pointed out above, a liquid flow path of the known liquid ejection apparatus comprises liquid ejection heads, liquid cartridges and a liquid ejection recovery system that are typically arranged in a manner as shown in FIG. 2. Referring now to FIG. 2, the liquid cartridge 102 (which corresponds to liquid cartridge 202 in FIG. 6) comprises a liquid bag 103, a housing 104 containing the liquid bag 103, a rubber peg 105 forming a supply port for leading liquid out of the liquid bag 103, a rubber peg holder 106 and a detector plate 107 for detecting the amount of the remaining liquid. The rubber peg holder 106 is made of resin and adapted to hold the rubber peg 105. It has an end whose outer periphery is held in tight contact with the inner surface of the liquid bag 103. The rubber peg holder 106 has a flange 108 that is rigidly fitted to the housing 104. The liquid bag 103 has two oppositely disposed sides whose areas are the largest among all the sides of the bag. One of these two sides, which faces downward, is securely fitted to a side of the housing 104 by means of an adhesive or bonding agent, while the other side, which faces upward, holds the detector plate 107, which is rigidly fitted to a part of that side of the bag.

The apparatus main body comprises a cartridge-containing section 109 for containing a liquid cartridge 102. A hollow needle 110 is arranged at the cartridge-containing section 109 and communicates with the liquid ejection head 101 by way of a supply tube 111 so that, as the liquid cartridge 102 is put into the cartridge-containing section 109, the hollow needle 110 is driven to go through the rubber peg 105 of the liquid bag 103. Then, liquid can be supplied from the liquid bag 103 to the liquid ejection head 101.

In the instance of FIG. 6, four liquid cartridges 202 are provided for the four liquid ejection heads 201. When recording color images, typically cyan, magenta, yellow and black inks are contained respectively in the four liquid cartridges 202 for the four liquid ejection heads 201 so that the liquid ejection heads 201 can record images using these color inks. As seen from FIG. 2, a plastic liquid bag 103 is put in each of the liquid cartridges (202 in FIG. 6 and 102 in FIG. 2) and ink is supplied from the liquid bag 103 to the corresponding liquid ejection head 101 by way of the supply tube 111.

As liquid is supplied from the liquid bag 103 in the liquid cartridge 102 and ejected from the liquid ejection head 101 that communicates with the liquid bag 103 by way of the supply tube 111, the internal pressure of the liquid ejection head 101 falls. Then, more liquid is supplied from the liquid bag 103 to the liquid ejection head 101 by way of the supply tube 111 to compensate for the reduced internal pressure.

A volume-of-remaining-liquid detecting means 112 is provided in the cartridge-containing section 109 in order to detect the amount of liquid in the liquid bag 103. The volume-of-remaining-liquid detecting means 112 typically comprises a detection lever 113 arranged in the cartridge-containing section 109 and pivoted by a shaft 114 and a photo interrupter 115. The detection lever 113 is urged counterclockwise by a spring (not shown) and has an end that is held in contact with a detection plate 107 rigidly secured to the upper surface of the liquid bag 103. Thus, as the liquid in the liquid bag 103 is gradually consumed to lower the detection plate 107 as indicated by broken lines in FIG. 2, the detection lever 113 turns counterclockwise. Then, the other end of the lever interrupts the light beam of the photo interrupter 115 so that a signal is generated to notify the user that the liquid in the liquid cartridge 102 is almost gone and to prompt him or her to replace it.

As pointed out earlier, the liquid ejection recovery system 120 (220 in FIG. 6) is provided to avoid defective liquid ejection (including non-ejection) and maintain the normal function of liquid ejection of the liquid ejection head 101. As shown in FIG. 2, the liquid ejection recovery system 120 is provided with a cap 121 (221 in FIG. 6) for capping the liquid ejection head 101 and a suction pump 122. The inside of the cap 121 is linked to the liquid suction port of the suction pump 122 by way of a tube 123. On the other hand, the liquid delivery port of the suction pump 122 is linked by way of a tube 124 to a waste liquid tank 125 that contains a waste liquid absorbent 126. The waste liquid tank 125 is provided at the top thereof with an atmosphere communication port 127. When the liquid ejection apparatus is used for the first time for liquid ejection (image recording) after shipment, the liquid ejection head 101 is moved to the home position where the liquid ejection recovery system 120 is arranged and capped by the cap 121 of the liquid ejection recovery system 120 at that position. Then, the suction pump 122 of the liquid ejection recovery system 120 is operated to produce negative pressure at the liquid ejection port and introduce liquid from the liquid bag 103 into the liquid ejection head 101 by way of the supply tube 111.

In the liquid ejection apparatus having the above-described liquid flow paths, as liquid is ejected from the liquid ejection head 101 and thus consumed from the liquid bag 103, the liquid bag 103 in the liquid cartridge 102 gradually becomes flat. Then, the detection plate rigidly secured to the top surface of the liquid bag 103 moves downward accordingly. The position of the detection plate 107 is detected by the volume-of-remaining-liquid detecting means 112. Since the detection lever 113 of the volume-of-remaining-liquid detecting means 112 is urged counterclockwise by a spring, it turns counterclockwise as the detection plate 107 gradually falls as the liquid is consumed and, when the detecting plate 107 gets to the position indicated by broken lines in FIG. 2, the upper end of the detection lever 113 interrupts the light beam of the photo interrupter 115, which in turn generates a signal for notifying the user that the liquid in the liquid cartridge 102 is almost gone and prompting him or her to replace it.

Generally, the internal pressure of the liquid ejection head 101 needs to be kept at a level slightly lower than the atmospheric pressure (or show negative pressure) in order to avoid any leakage of liquid from the liquid ejection port of the liquid ejection head 101 and maintain the normal function of liquid ejection thereof. The pressure difference (negative pressure) is produced by the difference in height, h, between the level of the liquid ejection port of the liquid ejection head 101 and the level of the liquid bag 103. The internal pressure of the liquid ejection head 101 should be kept between 100.345 kPa and 101.131 kPa (between −20 and −100 mm $H_2O$ in terms of negative pressure), and fluctuations of the internal pressure need to be minimized. Therefore, the liquid bag 103 is required to be soft but not to be highly resilient. Additionally, the liquid bag 103 is required to operate as a gas barrier in order to prevent changes in the liquid density due to evaporation, and also to be resistant against chemicals in order to avoid degradation of quality of the liquid in the bag. FIG. 3 shows a liquid bag that can meet these requirements. The liquid bag 103 illustrated in FIG. 3 is prepared by laying two multilayer films, each obtained by laying a resin film on an aluminum film, and welding the peripheral sections 103*a* through 103*d* thereof by heat. A rubber peg holder 106 holding a rubber peg 105 inside it is inserted at the middle of the peripheral section 103*d* and the lateral surface of the rubber peg holder 106 is welded to the surrounding films by heat to produce a hermetically sealed structure. The use of the aluminum film provides the liquid bag 103 with flexibility and a capability of operating as a gas barrier. Additionally, the use of the resin film such as a polyethylene film provides the liquid bag 103 with resistance against chemicals.

SUMMARY OF THE INVENTION

In the known liquid ejection apparatus having the above-described flow path structure and adapted to use a liquid bag of the above-described type, the internal pressure (negative pressure) of the liquid ejection head changes as a function of the amount of liquid contained in the liquid bag. When the bag is almost full of liquid, the expanded bag tends to be restored to its original form so that the internal pressure of the liquid ejection head comes close to the atmospheric pressure (to reduce the negative pressure). However, as the amount of liquid in the liquid bag is reduced, the internal pressure of the liquid ejection head falls (to increase the negative pressure).

FIG. 5 shows a graph obtained by observing the change in the internal pressure of the liquid ejection head when a liquid bag with internal dimensions of 80 mm×150 mm was used and the amount of liquid in the bag was made to vary. In the graph of FIG. 5, the horizontal axis indicates the volume of liquid (cc) in the liquid bag and the vertical axis indicates the internal pressure (kPa) of the liquid ejection head (the vertical axis at the right side indicating the corresponding negative pressure (mm $H_2O$)). The pressure (negative pressure) changes remarkably when the volume of liquid is less than 20 cc but increases gradually when the volume of liquid exceeds 20 cc. However, the pressure increases rapidly once the volume of liquid exceeds 150 cc. Thus, a liquid bag of this type can feasibly be used when the volume of liquid contained therein is between 20 cc and 150 cc, at which volumes the internal pressure (negative pressure) of the liquid ejection head changes little. Thus, the maximum feasible volume of liquid is 150 cc, and 20 cc of liquid is left unconsumed. Then, the internal pressure of the liquid ejection head changes within the range of 100.443 kPa to 101.031 kPa (within the range of −30 to −90 mm $H_2O$ in terms of negative pressure).

It is also known that the internal pressure (negative pressure) of the liquid ejection head 101 (201 in FIG. 6) changes as the carriage (210 in FIG. 6) reciprocates. To be more accurate, since the liquid in the supply tube 111 (203 in FIG. 6) is driven to move within the tube 111 (203 in FIG. 6) by acceleration as the carriage (210 in FIG. 6) moves, the internal pressure (negative pressure) of the liquid ejection head 101 (201 in FIG. 6) changes. Therefore, as the carriage is moved at a high rate of acceleration in order to accommodate the demand for high-speed printing, the change in the internal pressure (negative pressure) increases.

However, the above arrangement of liquid flow paths and the liquid cartridge of the prior art does not provide any substantial margin for the internal pressure (negative pressure) of the liquid ejection heads. This means that the demand for high-speed printing can hardly be met with such an arrangement.

Additionally, it is a serious problem from an economic point of view that 20 cc of liquid is left unused out of 150 cc of liquid contained in a liquid bag. The volume of 20 cc constitutes more than 10% of the total amount of liquid contained in the bag. The unused 20 cc is normally thrown away and seriously affects the environment.

In view of the above-identified problems of the prior art, it is therefore the object of the present invention to provide a liquid ejection apparatus that can increase the moving speed of its carriage by reducing the change in the internal pressure (negative pressure) of the liquid ejection head thereof as a function of the volume of liquid in the liquid bag containing liquid to be supplied to the liquid ejection head, and can reduce the volume of liquid that is left unused.

According to the invention, the above object is achieved by providing a liquid ejection apparatus comprising a liquid bag for containing liquid to be supplied to a liquid ejection head and adapted to generate negative pressure in the liquid ejection head by a water head difference between the liquid ejection head and the liquid bag, the liquid bag being arranged so that, of two sides of the liquid bag having the largest areas, the side facing in the direction opposite to the direction of gravity (i.e., the side facing upward when the liquid bag is mounted in the liquid ejection apparatus and the apparatus is operational) is rigidly held at least partly and the other side, which faces in the direction of gravity (i.e., the side facing downward when the liquid bag is mounted in the liquid ejection apparatus and the apparatus is operational), is freely movable, the liquid bag being provided with a means for detecting an amount of liquid remaining in the liquid bag by reference to a position of the side facing in the direction of gravity, the detecting means being adapted to move according to the amount of liquid contained in the liquid bag.

Preferably, in a liquid ejection apparatus according to the invention, the liquid bag is rigidly secured in an area comprising between 20% and 60% of the area that can be used for containing liquid.

According to the invention, in a liquid ejection apparatus comprising a liquid bag for containing liquid to be supplied to a liquid ejection head and adapted to generate negative pressure in the liquid ejection head by a water head difference between the liquid ejection head and the liquid bag, the change in the internal pressure (negative pressure) of the liquid ejection head as a function of the change in the volume of liquid in the liquid bag can be minimized so as to increase the moving speed of the carriage and reduce the volume of the liquid that is left unused in the bag, because the liquid bag is arranged as to make a so that, of two sides of the liquid bag having the largest areas, the side facing in the direction opposite to the direction of gravity is rigidly held, at least partly, while the other side, which faces in the direction of gravity, is freely movable.

DESCRIPTION OF THE PREFERRED EMBODIMENT

Now, the invention will be described further by referring to the accompanying drawings that illustrate a preferred embodiment of the invention.

Figure 1:
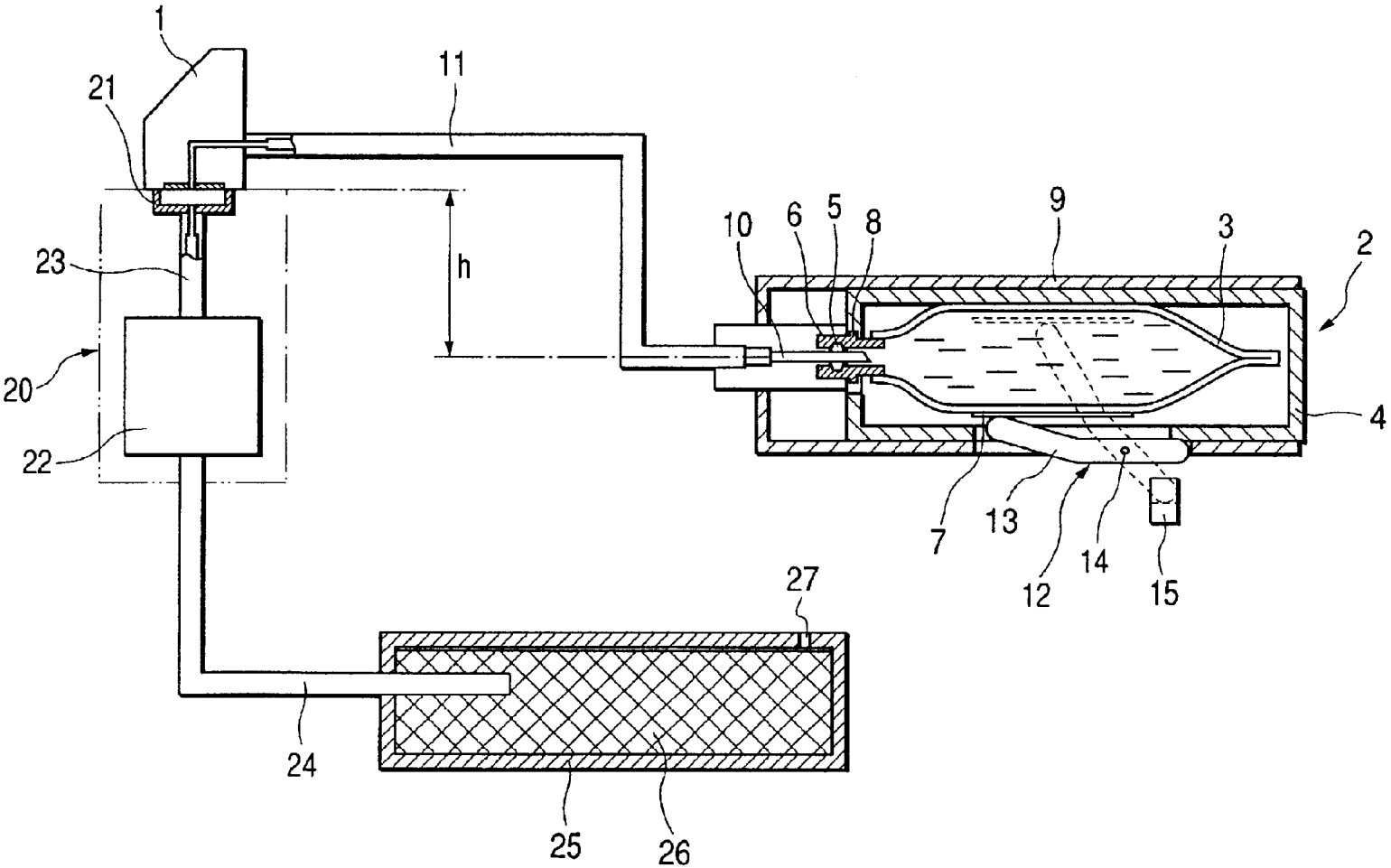
FIG. 1 is a schematic illustration of a liquid flow path including a liquid ejection head, a liquid cartridge and a liquid ejection recovery system that is comprised in a liquid ejection apparatus according to the invention.

FIG. 1 is a schematic illustration of a liquid flow path including a liquid ejection head, a liquid cartridge and a liquid ejection recovery system that is comprised in a liquid ejection apparatus according to the invention.

Referring to FIG. 1, the liquid ejection head 1 is capped by the liquid ejection recovery system 20 at the home position thereof. The liquid ejection recovery system 20 is provided to avoid defective liquid ejection (including non-ejection) and maintain the normal function of liquid ejection of the liquid ejection head 1. It comprises a cap 21 for hermetically sealing (capping) the liquid ejection ports of the corresponding liquid ejection head 1 and a suction pump 22, which is connected to the inside of the cap 21 by way of a tube 23. The liquid delivery port of the suction pump 22 is linked to a waste liquid tank 25 by way of a tube 24. The waste liquid tank 25 contains therein a waste liquid absorbent 26 and is provided at the top thereof with an atmosphere communication port 27. Thus, as the suction pump 22 of the liquid ejection recovery system 20 is driven to operate while the liquid ejection ports of the liquid ejection head 1 are capped so as to apply negative pressure to the liquid ejection port, foreign objects in the liquid ejection ports including thickened liquid, air bubbles and dust are drawn out with liquid and then driven into the waste liquid tank 26.

Figure 2:
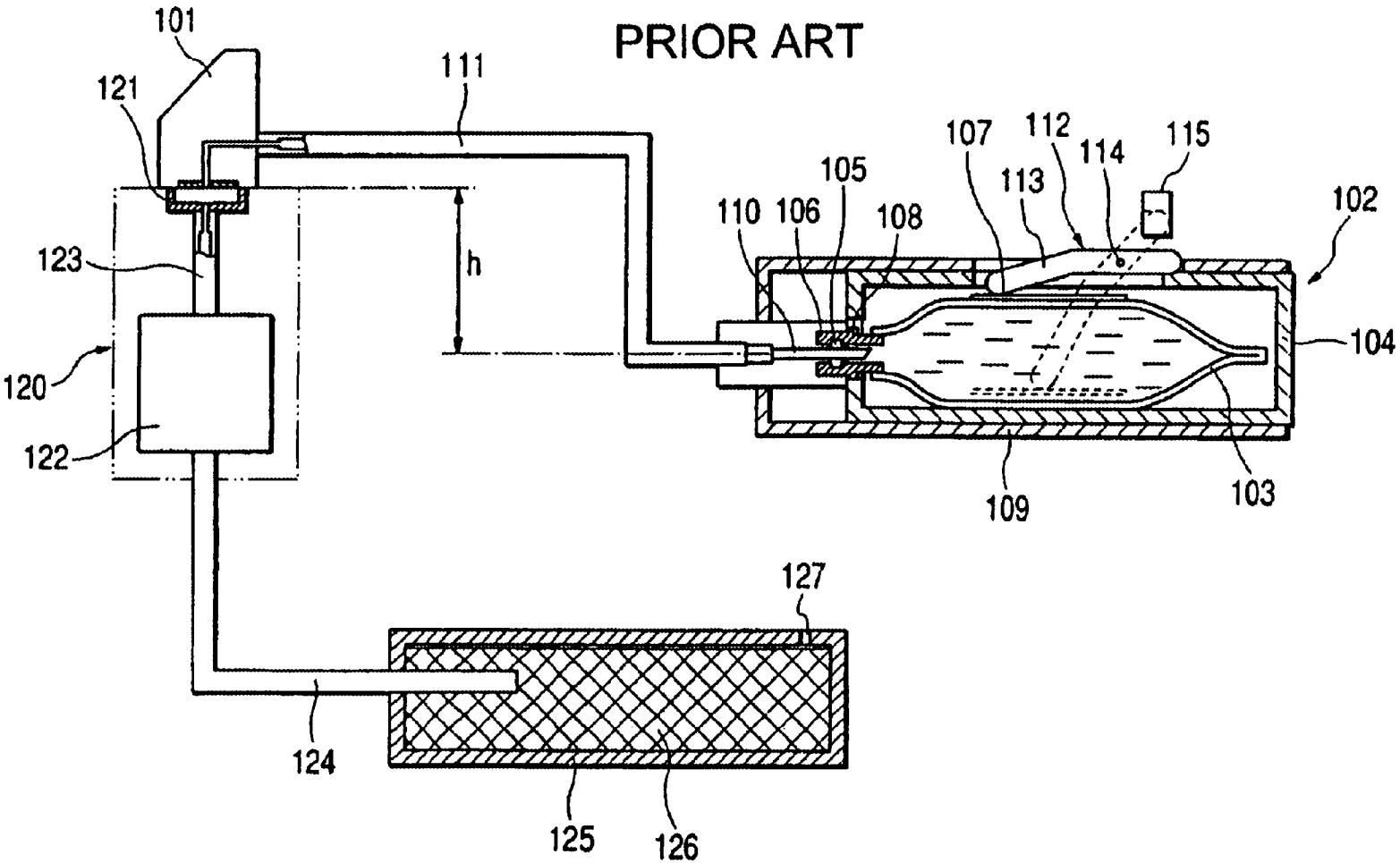
FIG. 2 PRIOR ART
FIG. 2 is a schematic illustration of a liquid flow path including a liquid ejection head, a liquid cartridge and a liquid ejection recovery system that is comprised in a known liquid ejection apparatus.

Still referring to FIG. 1, a liquid cartridge 2 is also shown. It comprises a liquid bag 3, a housing 4 for containing the liquid bag 3, a rubber peg 5 for forming a supply port through which liquid is drawn out from the liquid bag 3, a rubber peg holder 6 and a detection plate 7 rigidly secured to part of the lower surface of the liquid bag 3 and adapted to detect the volume of liquid remaining in the bag 3. The rubber peg holder 6 is made of resin and adapted to hold the rubber peg 5. It has an end that is bonded at the outer periphery thereof to the inner surface of the liquid bag 3 by welding. The rubber peg holder 6 also has a flange 8 rigidly secured to the housing 4. While the liquid bag 3 itself is similar to the above-described known liquid bag 103 (see FIGS. 2 and 3), it differs from the latter in that, of the two sides of the liquid bag having the largest areas, the side facing in the direction opposite to the direction of gravity, or the upper outer surface, is rigidly held, partly, to the upper inner surface of the housing 4 by means of an adhesive or bonding agent. If the bonded area is too small, the liquid bag 3 can come off from the upper inner surface of the housing 4. If, on the other hand, the bonded area is too large, the liquid bag 3 will be prevented from freely expanding. Therefore, the bonded area of the liquid bag is preferably between 20% and 60% of the area of the upper surface of the liquid bag that can be used for containing liquid. A detection plate 7 for detecting the amount of liquid remaining in the liquid bag is rigidly secured to the lower surface of the liquid bag 3, which surface is freely movable and moves as the amount of liquid changes. Thus, the detection plate 7 moves upward as the amount of liquid in the liquid bag decreases.

A hollow needle 10 is arranged at the cartridge-containing section 9 belonging to the apparatus main body and adapted to contain the liquid cartridge 2. The hollow needle 10 communicates with the liquid ejection head 1 by way of a supply tube 11 and, as the liquid cartridge 2 is put into the cartridge-containing section 9, the hollow needle 10 is driven to go through the rubber peg 5 of the liquid cartridge 2. Then, liquid can be supplied from the liquid bag 3 to the liquid ejection head 1.

A volume-of-remaining-liquid detecting means 12 is provided in the cartridge-containing section 9 in order to detect the amount of liquid in the liquid bag 3. The volume-of-remaining-liquid detecting means 12 comprises a detection lever 13 arranged in the cartridge-containing section 9 and pivoted by a shaft 14, and a photo interrupter 15. The detection lever 13 is urged clockwise by a spring (not shown) and has an end that is held in contact with a detection plate 7 rigidly secured to the lower surface of the liquid bag 3. Thus, as the liquid in the liquid bag 3 is gradually consumed, thereby raising the detection plate 7 as indicated by broken lines in FIG. 1, the detection lever 13 turns clockwise. Then, the other end of the detection lever 13 interrupts the light beam of the photo interrupter 15 so that a signal is generated to notify the user that the liquid in the liquid cartridge 2 is almost gone and to prompt him or her to replace it.

In the liquid ejection apparatus having the above-described liquid flow path, as liquid is ejected from the liquid ejection head and consumed, the liquid bag 3 in the liquid cartridge 2 gradually becomes flat. The detection plate 7 rigidly secured to the lower surface of the liquid bag 3 moves upward accordingly. The position of the detection plate 7 is detected by the-volume-of remaining-liquid detecting means 12. Since the detection lever 13 of the volume-of-remaining-liquid detecting means 12 is urged clockwise by a spring, it turns clockwise as the detection plate 7 gradually rises in conjunction with the consumption of liquid and, when the detecting plate 7 gets to the position indicated by broken lines in FIG. 1, the lower end of the detection lever 13 interrupts the light beam of the photo interrupter 15, which in turn generates a signal for notifying the user that the liquid in the liquid cartridge 2 is almost gone and prompting him or her to replace it.

Thus, in this embodiment, when the liquid bag 3 contains a relatively large amount of liquid, the force trying to restore the shape of the liquid bag that is expanded and the force trying to press down the lower side of the liquid bag by the weight of the liquid contained in the bag offset each other so that the change in the internal pressure (negative pressure) of the liquid ejection head 1 produced by the difference in height, h, between the level of the liquid ejection port of the liquid ejection head 1 and the level of the liquid bag 3 is minimized.

Figure 3:
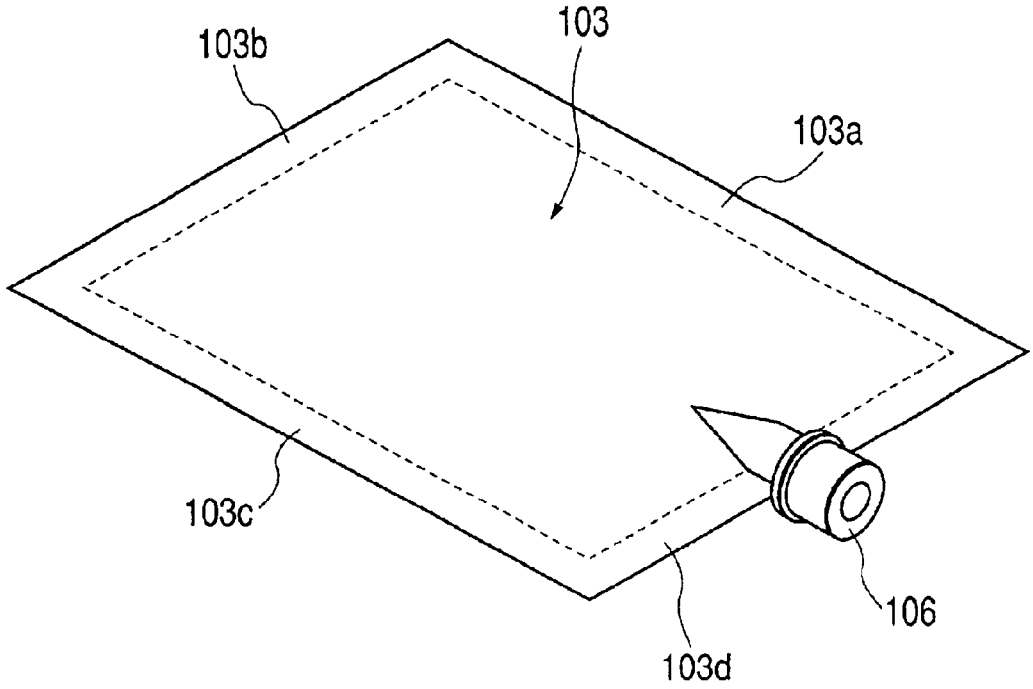
FIG. 3 is a schematic perspective view of an ordinary liquid bag used in a liquid ejection apparatus.
Figure 4:
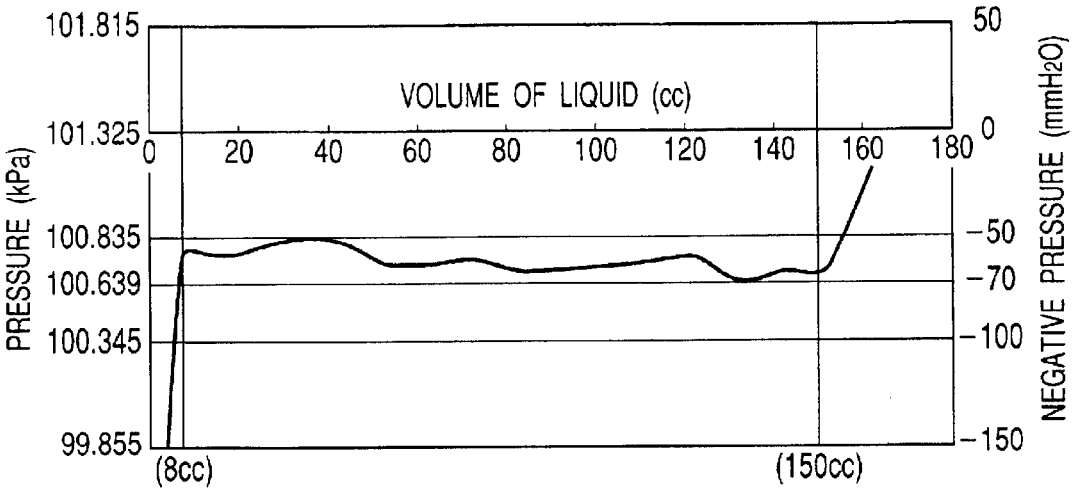
FIG. 4 is a graph illustrating the change in the internal pressure (negative pressure) of a liquid ejection head that occurs when the volume of liquid contained in a corresponding liquid bag is made to change in a liquid ejection apparatus according to the invention.
Figure 5:
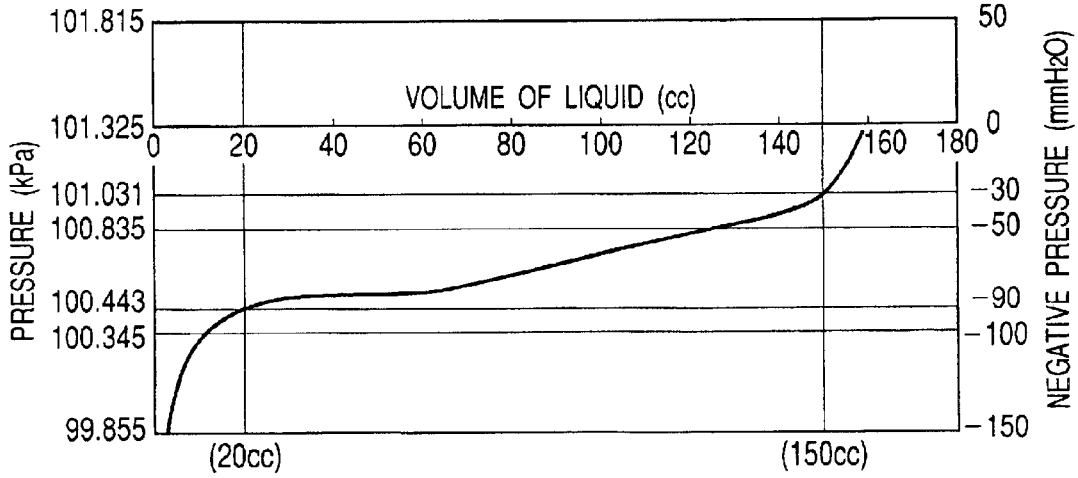
FIG. 5 is a graph illustrating the change in the internal pressure (negative pressure) of a liquid ejection head that occurs when the volume of liquid contained in a corresponding liquid bag is made to change in a known liquid ejection apparatus.
Figure 6:
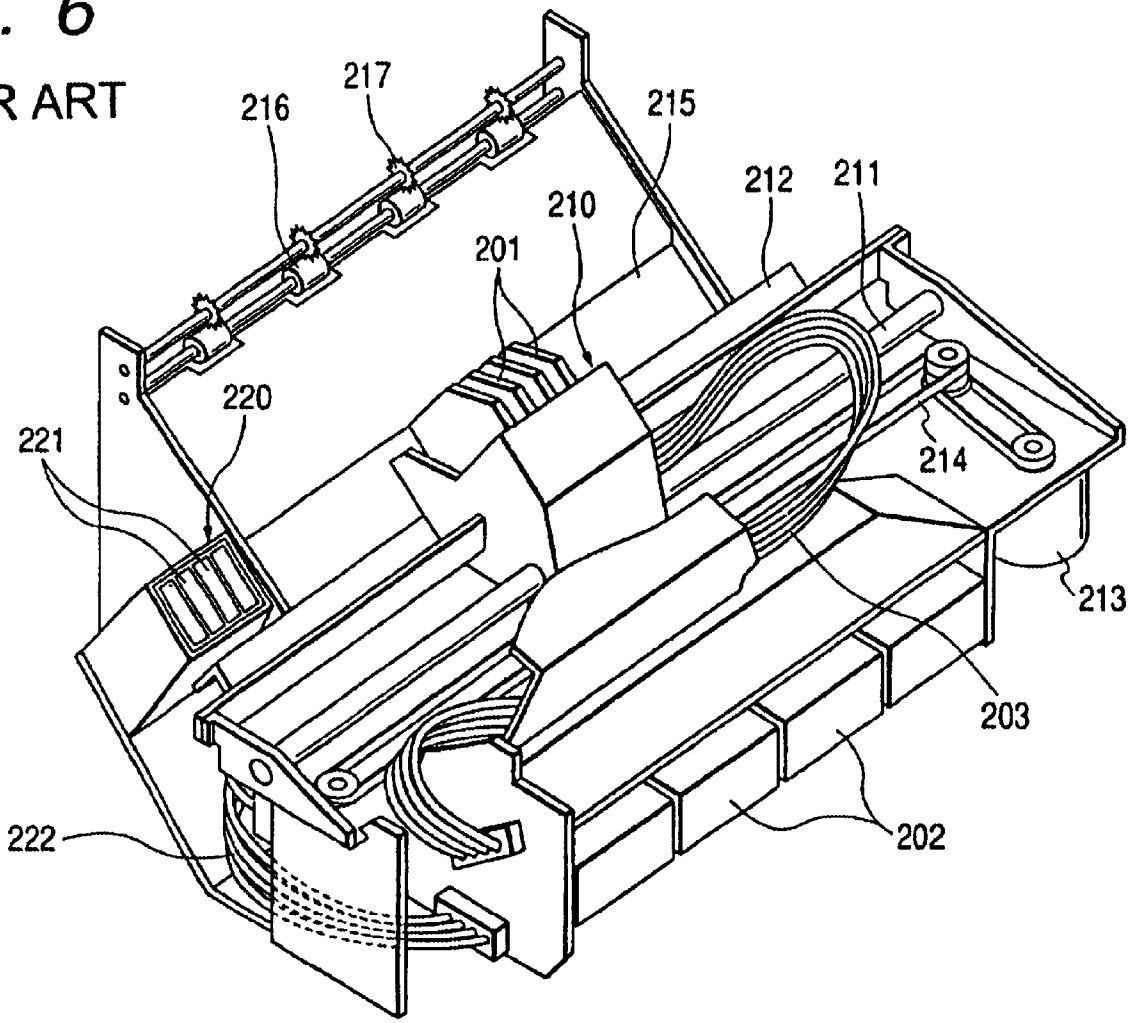
FIG. 6 PRIOR ART
FIG. 6 is a schematic perspective view of a common liquid ejection apparatus.

FIG. 4 shows a graph obtained by observing the change in the internal pressure of the liquid ejection head of this embodiment when a liquid bag with internal dimensions of 80 mm×150 mm as shown in FIG. 3 was used and the amount of liquid in the bag was made to vary. In the graph of FIG. 4, the horizontal axis indicates the volume of liquid (cc) in the liquid bag and the vertical axis indicates the internal pressure (kPa) of the liquid ejection head (the vertical axis at the right side indicating the corresponding negative pressure (mm $H_2O$)). The pressure (negative pressure) changes remarkably when the volume of liquid is less than 8 cc but is generally constant when the volume of liquid exceeds about 8 cc. The pressure increases rapidly once the volume of liquid exceeds 150 cc as in the case of the above-described known apparatus.

Thus, with the above structure of the liquid cartridge of this embodiment, the liquid bag can feasibly be used when the volume of liquid contained therein is between 8 cc and 150 cc at which volumes the internal pressure (negative pressure) of the liquid ejection head changes little. Thus, the maximum feasible volume of liquid is 150 cc, as in the case of the known apparatus, but only 8 cc of liquid is left unconsumed. Then, as seen from FIG. 4, the internal pressure of the liquid ejection head changes only within the range of 100.639 kPa to 100.835 kPa (within the range of −50 to −70 mm $H_2O$ in terms of negative pressure). While the pressure changes within a range of about 0.588 kPa (about 60 mm $H_2O$) in the above-described known apparatus, in this embodiment it changes only within a range of about 0.195 kPa (about 20 mm $H_2O$), a range that is one third as wide as that of the known apparatus. This means that the reciprocating speed of the carriage can be increased accordingly to make the liquid ejection apparatus adapted to high-speed printing.

Additionally, the amount of liquid that is left unused is reduced from 20 cc of the prior art to 8 cc, a great advantage of the embodiment from the viewpoint of both economy and the effect on the environment.

While the liquid bag of this embodiment is prepared by laying two films and bonding them along the periphery thereof, the present invention is by no means limited thereto and a bag of any other form may alternatively be used for the purpose of the invention. For example, a box-shaped bag formed by producing creases on a film and bending it along the creases may be used for the purpose of the invention.

While the liquid cartridge is removably fitted to the liquid cartridge-containing section in the above-described embodiment, the present invention is by no means limited to the use of such a liquid cartridge.

While the liquid bag is arranged horizontally in the above-described embodiment, the posture of the bag is by no means limited thereto. For example, it may be so arranged as to have an inclined posture for the purpose of the invention. In short, it is only necessary that the side of the bag that is expanded by the weight of the liquid in the bag be made freely movable while the opposite side is rigidly secured.

As described above in detail, according to the invention, there is provided a liquid ejection apparatus comprising a liquid bag for containing liquid to be supplied to a liquid ejection head and adapted to generate negative pressure in the liquid ejection head by a water head difference between the liquid ejection head and the liquid bag, wherein the change in the internal pressure (negative pressure) of the liquid ejection head as a function of the change in the volume of liquid in the liquid bag can be minimized to allow the moving speed of the carriage to increase and to reduce the volume of the liquid that is left unused in the bag, because the liquid bag is arranged so that, of the two sides of the liquid bag having the largest areas, the side facing in a direction opposite to the direction of gravity is rigidly held, at least partly, and the other side is freely movable.

What is claimed is:

1. A liquid ejection apparatus including a liquid ejection head and a liquid container comprising a liquid bag arranged in a housing for containing liquid to be supplied to said liquid ejection head, said apparatus having a structure adapted to generate negative pressure in said liquid ejection head as a result of a difference in height between said liquid ejection head and said liquid bag, wherein said liquid bag has first and second sides opposed to each other, said first side being rigidly held, at least partly, on an inner surface of said housing, while said second side is made freely movable, and said first side facing in a direction opposite to the direction of gravity and said second side facing in the direction of gravity when the liquid container is mounted in the apparatus, and wherein said apparatus is provided with means for detecting an amount of liquid remaining in said liquid bag as a result of sensing a position of said second side, said second side moving according to the amount of liquid contained in said liquid bag, and said detecting means having a portion adapted to move in accordance with a position of said second side.

2. An apparatus according to claim 1, wherein said first side of said liquid bag is rigidly secured in an area thereof comprising between 20% and 60% of the area that can be used for containing liquid.

* * * * *